United States Patent [19]

Ibach et al.

[11] 4,300,045

[45] Nov. 10, 1981

[54] BEAM GUIDANCE FOR ELECTRON BEAM TESTS, AND ELECTRON IMPACT SPECTROMETER HAVING SUCH BEAM GUIDANCE

[75] Inventors: Harald Ibach, Aachen-Verlautenheide; Hermann Froitzheim, AAchen; Heinz-Dieter Bruchmann; Sieghard Lehwald, both of Jülich, all of Fed. Rep. of Germany

[73] Assignee: Kernforschungsanlage Jülich Gesellschaft mit beschrankter Haftung, Jülich, Fed. Rep. of Germany

[21] Appl. No.: 107,592

[22] Filed: Dec. 27, 1979

[30] Foreign Application Priority Data

Dec. 27, 1978 [DE] Fed. Rep. of Germany ..... 2856244

[51] Int. Cl.[3] ..... H01J 40/00; H01J 47/00

[52] U.S. Cl. ..... 250/305; 250/310

[58] Field of Search ..... 250/305, 310, 281, 282, 250/287, 296, 398

[56] References Cited

U.S. PATENT DOCUMENTS 3,313,936 4/1967 Helmer et al. ..... 250/305

3,806,728 4/1974 Lindholm et al. ..... 250/305

4,126,782 11/1978 Usami et al. ..... 250/305

*Primary Examiner*—Bruce C. Anderson

*Attorney, Agent, or Firm*—Becker & Becker, Inc.

[57] ABSTRACT

A beam guidance for electron beam tests, especially of solid bodies. The electrons cathodically emitted and electron-optically bundled are subjected at least to an energy selection in a cylinder condenser deflection unit and are subsequently detected or indicated in a detector. The emission and bundling systems are arranged in such a way that the electrons, in the plane at right angles to the cylinder condenser axis, are focused upon the inlet shield or baffle of the condenser, yet are focused at right angles thereto upon the detector. Also disclosed is an electron impact spectrometer having such a beam guidance, and an emission system encompassing a cathode and a lens system for focusing an electron current or flow upon an inlet baffle of a monochromator, with such flow entering into the cylinder condenser monochromator for energy selection of the electrons, which emanate bundled from the monochromator and strike or fall upon the probe or test sample and after reflection thereon come by way of a lens system into the cylinder condenser analyzer and after energy selection and passage through the outlet baffle of the analyzer strike or impinge upon a detector.

7 Claims, 4 Drawing Figures

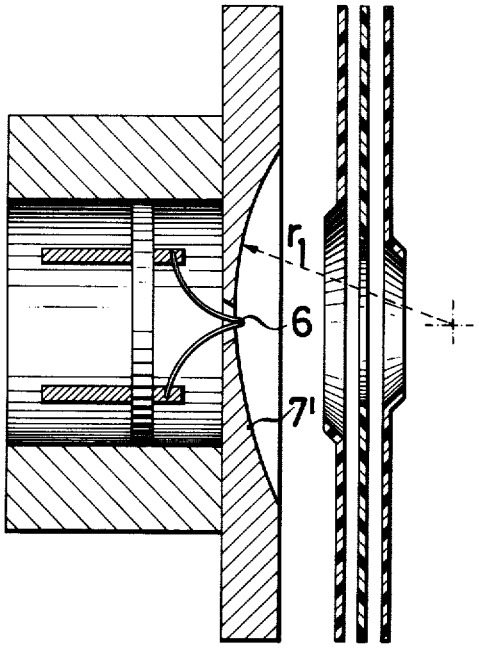
FIG. 1
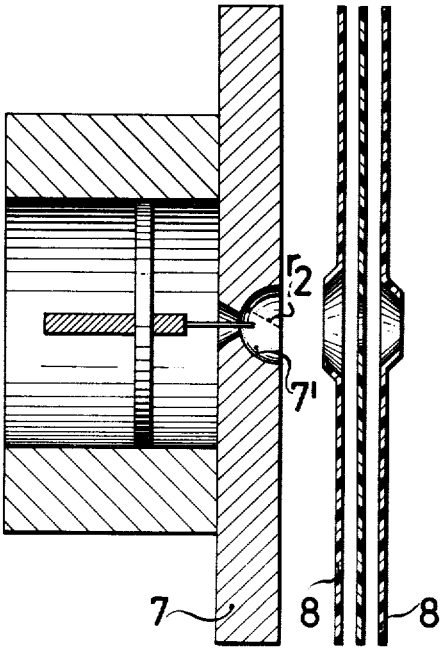

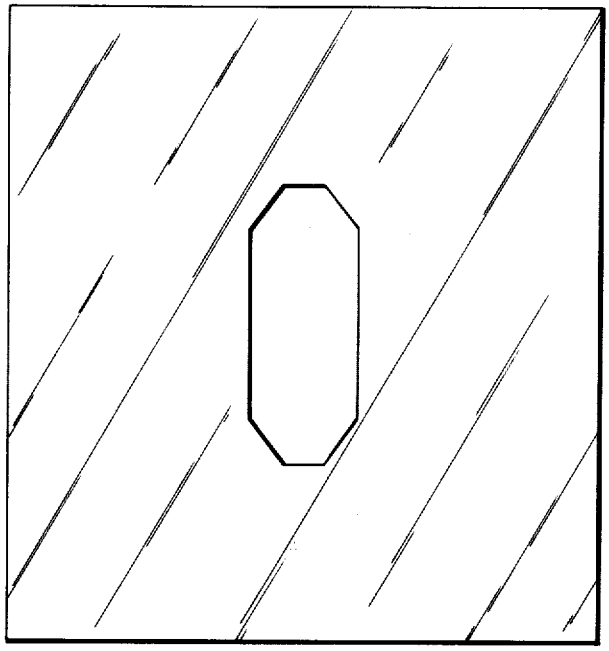
FIG. 2
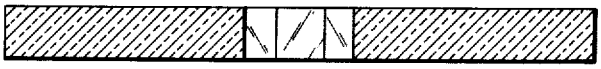

Energy Breadth $\Delta E$

Current at the detector

Current at the sample

BEAM GUIDANCE FOR ELECTRON BEAM TESTS, AND ELECTRON IMPACT SPECTROMETER HAVING SUCH BEAM GUIDANCE

The present invention relates to an electron beam guidance, with which the cathodically emitted and electron-optically bundled electrons are subjected at least to an energy selection in a cylinder condenser deflection unit and are finally detected or recorded with a detector. The present invention further encompasses an electron impact spectrometer having electrostatic cylinder-condenser-deflection units as energy dispersive units, in which an inventive beam guide is provided and which is conceived especially for collision or impact energies between 1 and 1000 eV.

Electron impact spectrometers (also called "electron-energy-loss spectrometers" or abbreviated "electron-spectrometer") are used for analysis of gases and solid bodies, whereby the relevant information is received in the form of characteristic energy losses after collision of the electrons with gas molecules or a solid body probe, sample or specimen. Recently, the application for determining vibration spectra of adsorbed substances, and thus in catalysis research, has become of special interest. For this purpose, the energy resolution of the utilized spectrometer must lie in a region of $\Delta E = 5$ to 10 meV. Especially with this application, the highest possible current, at a given resolution $\Delta E$, is required.

A special characteristic of such investigations is that the essential part of the electrons striking the sample are specularly reflected. This is true also for such electrons which have suffered energy losses by excitation of adsorbed substance vibrations (H. Ibach, J. Vac. Sci. Technology 9, 713 (1972) and E. Evans and D. L. Mills, Phys. Rev. B5, 4126 (1972)). Pursuant to these physical characteristics, the beam electron path is not influenced by the presence of the sample, aside from a beam deflection with respect to the focusing conditions, and the comparison of different types of spectrometers can occur by comparison of the characteristics thereof in a direct passage therethrough without presence of the sample.

It is known that the current is limited by space charging effects (H. Ibach, Applications of Surf. Sci., 1, 1(1979)). Consequently, there results a dependence of the transmitted current at the detector $I_D$ proportional to $\Delta E^{5/2}$. Different forms of embodiment of electrostatic electron impact spectrometers differ in the attained prefix or factor g in the equation $$I_D = g\Delta E^{5/2} \quad (1)$$

which simultaneously represents a basis or figure of the merit of the spectrometer. With a setting of the highest possible resolution, there is induced an additional drop of the transmitted current by increased image errors at low electron energies. The attainable resolution $\Delta E_{min}$ (conventionally measured as energy width at half signal current; English "FWHM"), at which the current still follows the equation (1), is therefore likewise *one* measure for the spectrometer quality.

Electron impact spectrometers for the described application have been realized with different types of energy dispersive elements. Cylinder condensers, spherical condensers and so-called cylinder mirrors especially have become known. The corresponding value for g and the best attained half value width or FWHM-value (as a measure for the resolution) are listed in the subsequent table, so far as in previous work, data have been given for the current at the detector

TABLE 1

| | $g\left(\frac{A}{(eV)^{5/2}}\right)$ | $\Delta E_{min}$(meV) | |
|---|---|---|---|
| Preston et.al., J. of Physics E. Sci. Instruments, 6, 661 (1973) | $3.6 \cdot 10^{-6}$ | 26 | spherical Condenser |
| Simpson, Rev. Sci. Instruments, 35, 1968 (1964) | $1.69 \cdot 10^{-8}$ | 5 | spherical Condenser |
| Stradling, Vacuum, 27, 595 (1977) | $6.3 \cdot 10^{-7}$ | 100 | spherical Condenser |
| Andersson, Solid State Commun. 21, 75 (1977) | $2.1 \cdot 10^{-9}$ | 6.8 | Cylinder Mirror |
| Company Prospectus Vacuum Generators | $5 \cdot 10^{-7}$ | 8.5 | Cylinder Condenser |

According to the foregoing listing provided in the table, the especially high resolutions are attained with spherical condenser units or cylinder mirror deflection units. Since, however, finishing and handling of cylinder condenser deflection units are considerably more simple, it is an object of the present invention to improve electron impact spectrometers with cylinder condenser deflection units such that more advantageous values for g and $\Delta E_{min}$ are obtained.

This object, and other objects and advantages of the present invention, will appear more clearly from the following specification in connection with the accompanying drawings, in which:

FIG. 1 schematically illustrates an emission system;

FIG. 2 illustrates a lens profile of the emission system of FIG. 1;

According to the present invention, a beam guidance of cathodically emitted and electron-optically bundled electrons, which are subjected at least to one energy selection by deflection in a cylinder condenser deflection unit and are finally detected or recorded with a detector, is characterized primarily by such an embodiment of the emission system and bundling systems that the electrons, in the plane at right angles to the cylinder condenser axis, are focused in a known manner upon the input diaphragm of the condenser, yet are focused at right angles thereto upon the detector. An electron impact spectrometer having such a beam guidance, and an emission system encompassing a cathode and a lens system for an electron beam focused upon the input diaphragm of a monochromator, which beam enters the cylinder condenser monochromator for energy selection of the electrons focused when leaving the monochromator and striking onto the probe or sample and after reflection thereon reaching the cylinder condenser analyzer by way of a lens system and after energy selection and passage through the output diaphragm of the analyzer striking onto a detector, is accordingly characterized primarily in that the emission system, which is differently conceived or shaped vertical or parallel to the monochromator cylinder axis, is embodied in such a way that the electrons, at right angles to the cylinder axis, are focused in a known manner upon the input diaphragm of the monochromator, while parallel to the cylinder axis a focusing upon the detector occurs, as well as being characterized by a lens system between the monochromator and the analyzer with focusing effect at right angles to the cylinder axis but without focusing effect parallel to the cylinder axis.

Preferably the emission system for this purpose encompasses a repeller at the cathode, the electron surface focusing different radii of curvature parallel and at right angles with respect to the monochromator-cylinder axis, whereby the radius of curvature being larger in the plane passing through the monochromator-cylinder axis than at right angles thereto. The present invention balances out the system conditioned disadvantages of cylinder condensers, which consist therein that these energy-dispersive elements focus only in one plane. Consequently, the attained value for g and $\Delta E_{min}$ are better (as set forth in the embodiment) than with previously known constructions, whereby as an additional advantage the comparatively simple finishing and production of cylinder condenser systems is decisive as the supporting factor.

Figure 4:
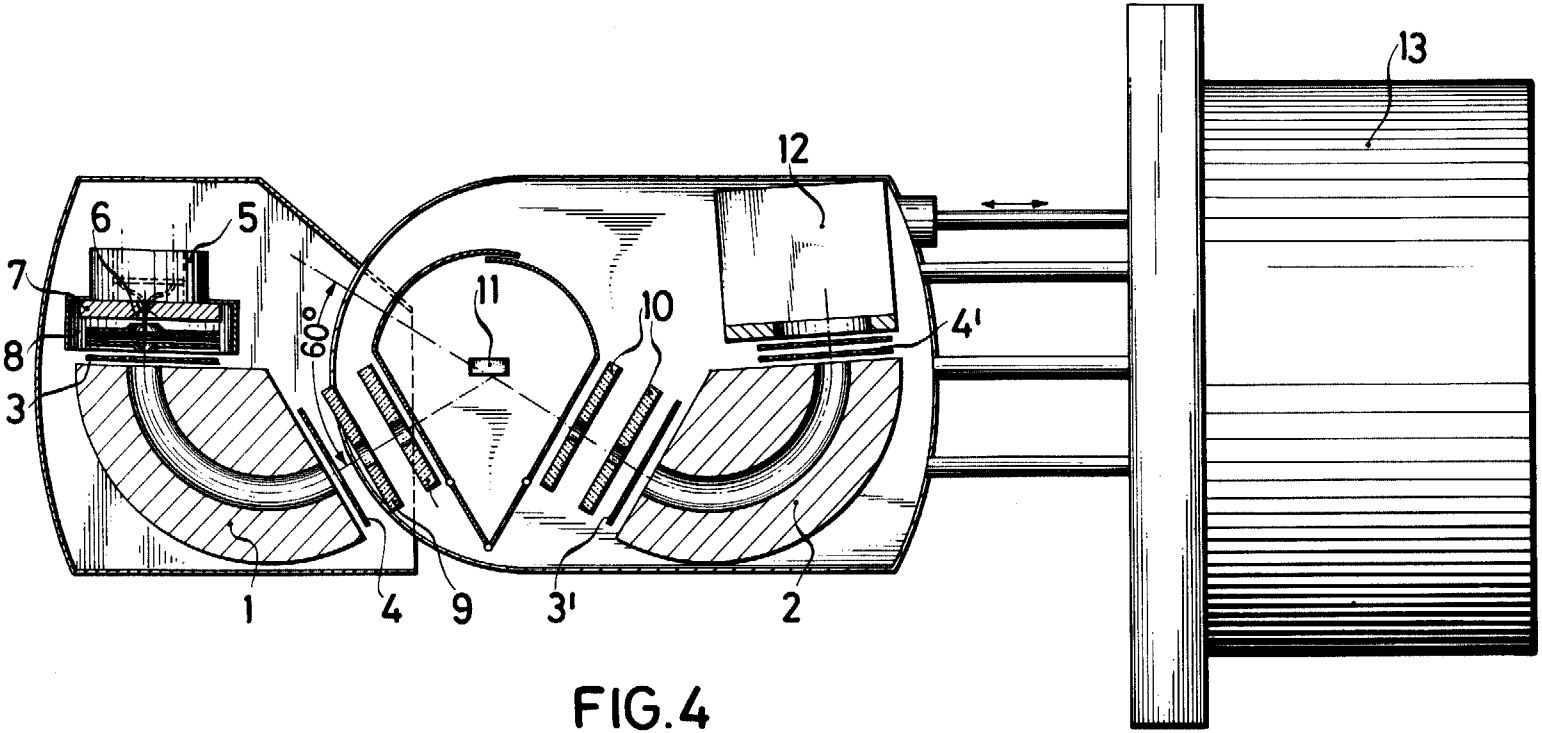
FIG. 4 illustrates the construction of a spectrometer.

For a more detailed statement of the present invention, the function of typical structure elements of the electron impact spectrometer of FIG. 4 is first described:

Electron impact spectrometers contain at least one energy dispersive system respectively as a monochromator 1 and an analyzer 2. Such energy dispersive system is self-focusing, which means electrons of the desired energy passing the input diaphragm 3,3' are focused upon the output diaphragm 4, 4'. In the case of cylinder condensers as energy dispersive elements, the input diaphragm and the output diaphragm conventionally are formed with longitudinal slits ("slitted diaphragms"), and the self-focusing occurs only in the plane perpendicular to the cylinder axis (viewing plane in FIG. 4; designated in the following paragraphs as the spectrometer plane).

An electron impact spectrometer furthermore includes a suitable system designated as an emission system in the following description; such a system for beam generation 5 (with emitting cathode 6, repeller 7, and suitably focusing elements 8), as well as a lens system 9 or 10 between the monochromator 1 and sample 11 or sample 11 and analyzer 2, which serves for beam guidance as well as focusing of electrons (moreover reflected at sample 11) from the output slit 4 of the monochromator 1 into the input slit 3' of the analyzer 2. The detection of the electrons occurs subsequently in the detector 12. The reference numeral 13 designates a supply unit.

In previously known electron impact spectrometers containing cylinder condensers emission systems and lens systems have been realized either circularly symmetrical to the beam axis (D. Roy and J. Carette in "Electronspectroscopy for Surface Analysis", ed. by H. Ibach, Springer 1977) or without any focusing perpendicular to the plane as shown in FIG. 4 (M. Probst and Th. C. Piper, J. Vac. Sci. Technology 4, 53 (1967) and H. Ibach, J. Vac. Sci. Technology 9, 713 (1972)).

Both of these schemes are apparently not well adapted to the characteristic of cylinder condensers focusing only in the plane perpendicular to the cylinder axis. With the circularly symmetrical system, the cathode emission can be focused to the input slit of the monochromator for instance by a suitable selection of the voltages. Apparently the thus focused electrons diverge, however, because of the circular symmetry, behind the focus not only in the spectrometer plane but also perpendicular thereto. Since the cylinder condenser does not focus perpendicular to the spectrometer plane, the predominant part of the electrons escapes detection and cannot be exploited for the desired investigations. The corresponding conditions are encountered in the further beam affecting units. Dispensing any focusing perpendicular to the spectrometer plane as shown in FIG. 4 leads apparently likewise to great losses of intensity.

According to the invention, practically a parallel beam is formed by the above defined embodiment of the emission system perpendicular to the spectrometer plane, and lens systems are used which, in the spectrometer plane, depict the output slit of the monochromator onto the input slit of the analyzer, though not influencing the beam perpendicular to the spectrometer plane, whereby the focus formed by the cathode system in this direction in the detector remains uninfluenced. Obviously, such an emission and lens system are matched or adapted to the focusing charactertiscs of cylinder condensers in an optimum manner. The corresponding characteristics of emission systems and lens systems are inventively attained by a corresponding configuration of the electrodes.

The defined beam guidance now leads not only to a good current yield (intense signal) at the detector, but also brings about advantages for the resolution of the system. The energetic resolution of a cylinder condenser is defined by the following equation:

$$\frac{\Delta E}{E} \cong \frac{s}{r} + \frac{h^2}{\pi^2 r^2} + \tfrac{3}{4}\alpha^2 \qquad (2)$$

wherein s and h are the slit width and slit height of the and output diaphragms (3, 3' and 4, 4' in FIG. 4), r is the radius of the cylinder condenser, E is the energy of the electrons in the cylinder condenser (1, 2), and $\alpha$ is the angular divergence perpendicular to the cylinder axis. The second term of the equation considers electrons or beams passing through the cylinder condenser from the upper edge of the input slit (3) to the lower edge of the input slit (4). Such electron paths are excluded by the inventive guidance of the beam, whereby the second term is eliminated with the result of having a correspondingly improved resolution with given energy of the electrons in the monochromator. Since, as is known to the expert or average man skilled in the art, this energy cannot by suitably reduced as a consequence of the localized inhomogeneity of the surface potential, the elimination of the term 2 in the equation (2) also represents a basic advantage with respect to the maximum attainable resolution. This theoretical discovery can be experimentally confirmed. For attaining a maximum resolution, inhomogeneity of the surface potential should be kept as small as possible. For this purpose, certain previously known spectrometers were additionally provided with heating devices or a coating with noble metals (Phys. Rev. 173, 222 (1968)). To avoid loading or charging of the electrodes, and for reduction of the secondary electron production, there became known furthermore the deposit of acetylene soot (J. A.

Prested, J. Phys. E, Scientific Instruments 6, 661 (1973)).

Such a coating with carbon also proves convenient with the present inventive spectrometer, an especially advantageous behavior of the system being is attained when the carbon coating is provided in the form of graphite, such as especially by dipping of the electrodes in a suspension of colloidal graphite and a brief, "baking" or "annealing" of the deposit.

The electron impact spectrometer illustrated in FIG. 4 and described in the foregoing paragraphs includes an emission system, the different focal lengths of which are realized by corresponding formation of the electrodes, as apparent from FIG. 1, showing in the upper part a vertical section and therebelow a horizontal section through the system. The different arrangement in both directions is clearly recognizable, especially the special configuration of the repeller 7 with a curved repeller surface 7' with differing radii of curvature $r_1$, $r_2$ in both directions and a lens system 8 adapted or matched thereto. The lenses 9, 10 used in the spectrometer between the monochromator 1 and the analyzer 2 have a longitudinal or elongated lens profile with truncated corners, as apparent from FIG. 2. The lenses 8 of the emission system have an analogous profile.

Figure 3:
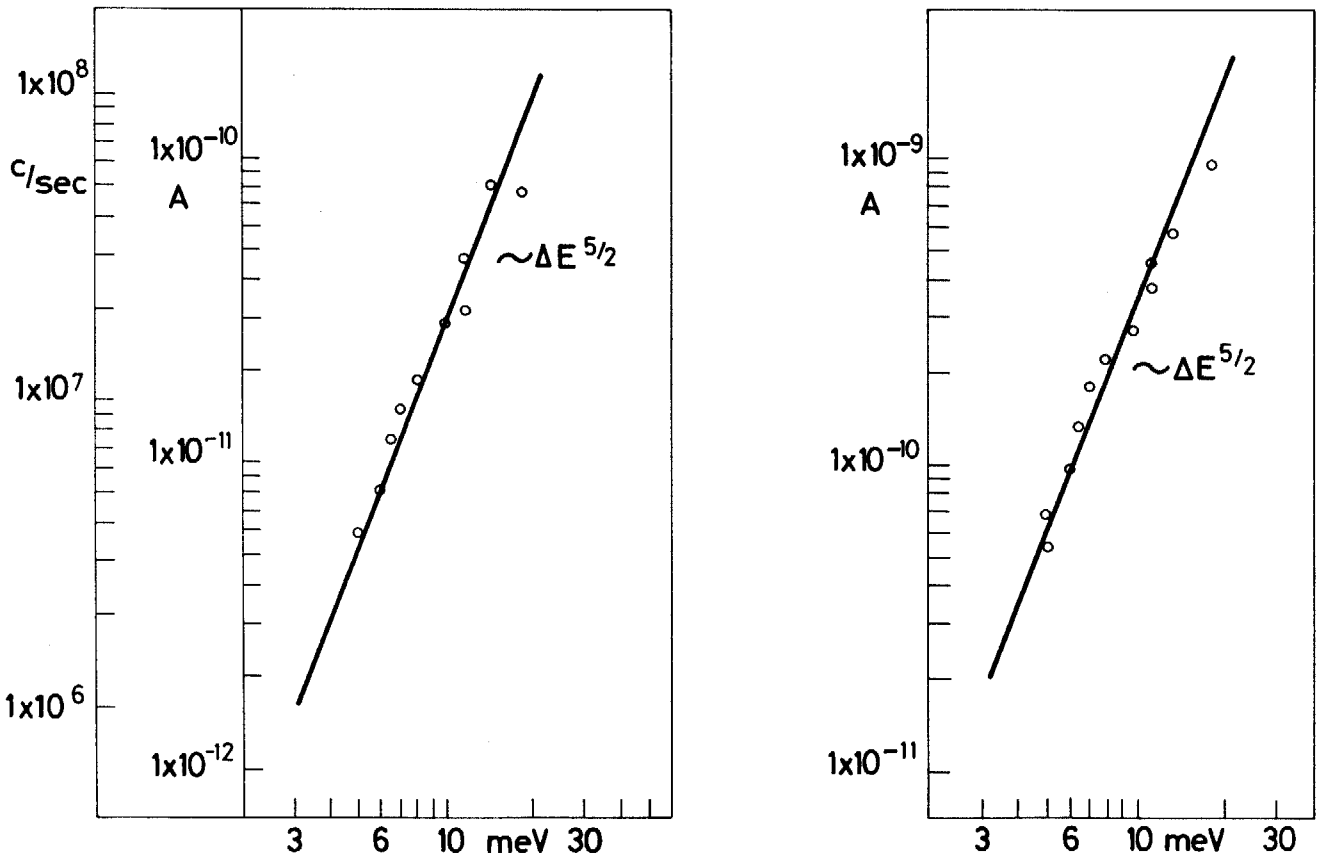
FIG. 3 illustrates curves for the measured electron current at the detector as a function of the energy width $\Delta E$.

In the elected example, the radius of the cylinder condensers amounts to $r=35$ mm, and the slit width $s=0.15$ mm. For investigations on a single-crystalline sample of limited size, there was selected as a slot height $h=4$ mm. The angular half-width is $\alpha=3°$. For testing the characteristic of the spectrometer, the current was measured at the sample position and at the detector as a function of the energy width $\Delta E$ (half-value width or FWHM) in a direct passage (see FIG. 3). The energy of the electrons at the sample under these circumstances was kept at 5 eV. The energy resolution of the monochromator and analyzer was maintained equal respectively. As apparent from FIG. 3, the current follows the theoretical relationship (equation 1) at the detector, without an apparent deviation from the theoretical power law even at $\Delta E=5$ meV. The g factor resulting from the curve amounts to $3.5\times10^{-6}$ A/(EV)$^{5/2}$. A maximum resolution of $\Delta E_{min}=5$ meV was attained. The comparison with table 1 shows that as a consequence of the present inventive features as described, for the first time resolutions in a range of 5 meV with acceptable current (g factor) were realized. Furthermore, the present invention makes possible the utilization of especially easy to finish and produce cylinder condensers as energy dispersive elements without loss of current and resolution.

The present invention is, of course, in no way restricted to the specific disclosure of the specification and drawings, but also encompasses any modifications within the scope of the appended claims.

What we claim is:

1. An electron impact spectrometer having a beam guidance for use on test samples for electron beam tests, especially of solid bodies, comprising in combination:

emission and bundling systems for cathodically emitting and electron-optically bundling electrons;

at least one cylinder condenser deflection unit means for subjecting electrons to an energy selection, said means being provided with diaphragm means for the input and output of electrons; and a detector for detecting electrons subjected to energy selection, said emission and bundling systems being adapted to the focusing of electrons only in a plane perpendicular to the axis of said cylinder condenser deflection unit onto the input of the condenser and at right angles thereto onto said detector, said deflection unit means including two cylinder condenser deflection units of which one operates as a monochromator with an inlet baffle means and the other as an analyzer;

an emission and bundling system encompassing a cathode and a first lens system for focusing cathodically emitted electrons onto the input of a cylinder condenser monochromator for energy selection of electrons which focusedly leaving said monochromator strike upon said test sample;

a cylinder condensor analyzer associated with said monochromator and being provided with an output means for passage of electrons to a detector;

a second lens system, arranged between said monochromator and said analyzer, for guidance of electrons reflected at said test sample, said emission and bundling system being arranged relative to said monochromator cylinder axis in such a way that electrons, at right angles to said cylinder axis, are focused upon the input of said monochromator, while parallel to said cylinder axis, electrons are focused upon said detector.

2. An electron impact spectrometer in combination according to claim 1, in which said cathode includes a repeller provided with a focusing surface having different radii of curvature parallel and perpendicular to said monochromator cylinder axis, the radius in the plane parallel to said monochromator cylinder axis being greater than that perpendicular thereto.

3. An electron impact spectrometer having the beam guidance for electron beam tests, especially of solid bodies, which comprises:

emission and bundling systems for cathodically emitting and electron-optically bundling electrons;

cylinder condenser deflection unit means for subjecting electrons at least to an energy selection, said means being provided with diaphragm means for the input and output of electrons; and a detector for detecting electrons subjected to energy selection, said emission and bundling systems being adapted to the focusing of electrons, in a plane perpendicular to the axis of said cylinder condenser deflection unit onto the input of the condenser and at right angles thereto onto said detector, said electron impact spectrometer for use on test samples further comprising:

an emission and bundling system encompassing a cathode and a first lens system for focusing cathodically emitted electrons onto the input of a cylinder condenser monochromator for energy selection of electrons which flow focused leaving said monochromator to strike upon said test sample;

cylinder condenser analyzer associated with said monochromator and being provided with an output means for passage of electrons to a detector;

a second lens system, arranged between said monochromator and said analyzer, for guidance of electrons reflected at said test sample, said emission and bundling system being arranged relative to said monochromator cylinder axis in such a way that electrons, at right angles to said cylinder axis, are focused upon the input of said monochromator, while parallel to said cylinder axis, electrons are adapted to be focused upon said detector, said cathode including a repeller provided with a focusing surface having different radii of curvature parallel and perpendicular to said monochromator cylinder axis, the radius in the plane parallel to said monochromator cylinder axis being greater than that perpendicular thereto, said input and output means of said monochromator and analyzer including slits, the height of which is greater than the root of the path radius and slit widths.

4. An electron impact spectrometer according to claim 3, in which said emission and bundling system is arranged at right angles to said monochromator cylinder axis.

5. An electron impact spectrometer according to claim 3, in which said emission and bundling system is arranged parallel to said monochromator cylinder axis.

6. An electron impact spectrometer according to claim 3, in which the beam guidance components, especially said diaphragms, lenses, and plates of condenser deflection unit means, are provided with a carbon coating.

7. An electron impact spectrometer according to claim 6, in which said carbon coating is produced by immersion in a colloidal graphite suspension and baking the deposit.

* * * * *